US011820145B2

(12) United States Patent
Sawada

(10) Patent No.: US 11,820,145 B2
(45) Date of Patent: Nov. 21, 2023

(54) INKJET PRINTER

(71) Applicant: Roland DG Corporation, Hamamatsu (JP)

(72) Inventor: Teppei Sawada, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 21 days.

(21) Appl. No.: 17/855,837

(22) Filed: Jul. 1, 2022

(65) Prior Publication Data

US 2023/0001694 A1 Jan. 5, 2023

(30) Foreign Application Priority Data

Jul. 5, 2021 (JP) ..... 2021-111268

(51) Int. Cl.
*B41J 2/165* (2006.01)
*B41J 29/393* (2006.01)
*B41J 2/175* (2006.01)

(52) U.S. Cl.
CPC ..... *B41J 2/16511* (2013.01); *B41J 2/17596* (2013.01); *B41J 29/393* (2013.01); *B41J 2002/16514* (2013.01)

(58) Field of Classification Search
CPC .. B41J 2/16511; B41J 2/17596; B41J 29/393; B41J 2/1721; B41J 2/175; B41J 29/38; B41J 2/16523; B41J 2/16508; B41J 2002/1742; B41J 2002/16514
See application file for complete search history.

(56) References Cited

U.S. PATENT DOCUMENTS

| | | | | |
|---|---|---|---|---|
| 8,979,243 | B2 * | 3/2015 | Igawa | B41J 2/16532 347/30 |
| 10,322,585 | B2 * | 6/2019 | Okuno | B41J 2/16505 |
| 10,717,284 | B1 | 7/2020 | Shelhart et al. | |
| 11,511,541 | B2 * | 11/2022 | Shinomiya | B41J 2/16517 |
| 2016/0001559 | A1 | 1/2016 | Tanjo | |

FOREIGN PATENT DOCUMENTS

| | | | |
|---|---|---|---|
| JP | 2016-55478 | A | 4/2016 |
| JP | 2020-142387 | A | 9/2020 |
| JP | 2020-179541 | A | 11/2020 |

* cited by examiner

*Primary Examiner* — An H Do
(74) *Attorney, Agent, or Firm* — KEATING & BENNETT, LLP

(57) ABSTRACT

A printer includes an ink head including a nozzle, a damper connected with the ink head, a pressure sensor to detect a damper pressure in the damper, a cap attachable to the ink head so as to cover the nozzle, an upward/downward moving mechanism to move the cap upward and downward with respect to the ink head, a suction pump connected with the cap, and a controller. The controller is configured or programmed to include a suction controller to execute a suction process to drive the suction pump in a state where the cap is attached to the ink head, a pressure acquisition controller to acquire the damper pressure from the pressure sensor during the suction process, and an upward/downward movement controller to control the cap to move upward toward the ink head when a change amount of the damper pressure is no larger than a reference change amount.

8 Claims, 10 Drawing Sheets

INKJET PRINTER

CROSS REFERENCE TO RELATED APPLICATIONS

This application claims the benefit of priority to Japanese Patent Application No. 2021-111268 filed on Jul. 5, 2021. The entire contents of this application are hereby incorporated herein by reference.

BACKGROUND OF THE INVENTION

1. Field of the Invention

The present invention relates to an inkjet printer.

2. Description of the Related Art

For example, Japanese Laid-Open Patent Publication No. 2016-55478 discloses a printer including a liquid spray that includes nozzles through which ink is sprayed, and a cap attachable to the liquid spray. The cap is provided to maintain spray characteristics of ink to be sprayed from the nozzles.

The cap is attachable to, or separable from, the liquid spray by a moving mechanism. The cap is put into contact with, and is attached to, the liquid spray so as to cover a space on which the nozzles are located. In this state, the space on which the nozzles are located may be tightly closed. The cap is attached to the liquid spray in this manner, so that the ink is suppressed from being evaporated from the nozzles and the ink discharged from the nozzles is recovered.

The cap is connected with, for example, a suction pump. The suction pump is driven in a state where the cap is attached to the liquid spray, so that a suction process of suctioning the ink from the liquid spray is performed. The cap is formed of, for example, rubber, and may be expanded or contacted by an aging deterioration. Such a cap formed of rubber may cause an aging change, for example, may be inflated, expanded or contracted, hardened, or softened by a contact thereof with the ink.

Such an aging deterioration or aging change of the cap causes a situation where the cap attached to the liquid spray does not closely contact the liquid spray and as a result, the space on which the nozzles are located is not tightly closed. In such a case, the suction process, even if executed, may not be performed properly, namely, the ink may not be suctioned from the liquid spray.

SUMMARY OF THE INVENTION

Preferred embodiments of the present invention provide inkjet printers each capable of performing a suction process properly.

An inkjet printer according to a preferred embodiment of the present invention includes an ink head, a damper, a pressure sensor, a cap, an upward/downward moving mechanism, a suction pump, and a controller. The ink head includes a nozzle through which ink is injected. The damper is connected with the ink head. The pressure sensor is configured or programmed to detect a damper pressure in the damper. The cap is attachable to the ink head so as to cover the nozzle. The upward/downward moving mechanism is configured or programmed to move the cap upward and downward with respect to the ink head. The suction pump is connected with the cap. The controller is configured or programmed to include a suction controller, a pressure acquisition controller, a determination controller, and an upward/downward movement controller. The suction controller is configured or programmed to execute a suction process to drive the suction pump in a state where the cap is attached to the ink head. The pressure acquisition controller is configured or programmed to acquire the damper pressure detected by the pressure sensor during the suction process. The determination controller is configured or programmed to determine whether a change amount of the damper pressure is no larger than a reference change amount. The upward/downward movement controller is configured or programmed to control the cap to move upward toward the ink head when the change amount is no larger than the reference change amount.

According to the inkjet printer, when the change amount of the damper pressure is large during the suction process, the pressure in the cap is of a negative level. Thus, it is considered that the ink is suctioned properly from the ink head. By contrast, when the change amount of the damper pressure is small during the suction process, the cap is not attached to the ink head properly. In this case, it is considered that the ink is not suctioned properly from the ink head. When the change amount of the damper pressure is no larger than the reference change amount, it is determined that the suction process is not performed properly because the change amount is small. Therefore, the cap is moved upward. This moves the cap toward the ink head, and is put into in closer contact with the ink head. As a result, the pressure in the cap is decreased to a sufficiently negative level. This allows the suction process to be performed properly.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of inkjet printers according to the present invention will be described with reference to the attached drawings. The preferred embodiments described herein are not provided with an intention to specifically limit the present invention, needless to say. Components and portions having the same functions will bear the same reference signs, and overlapping descriptions will be omitted or simplified when necessary.

Figure 1:
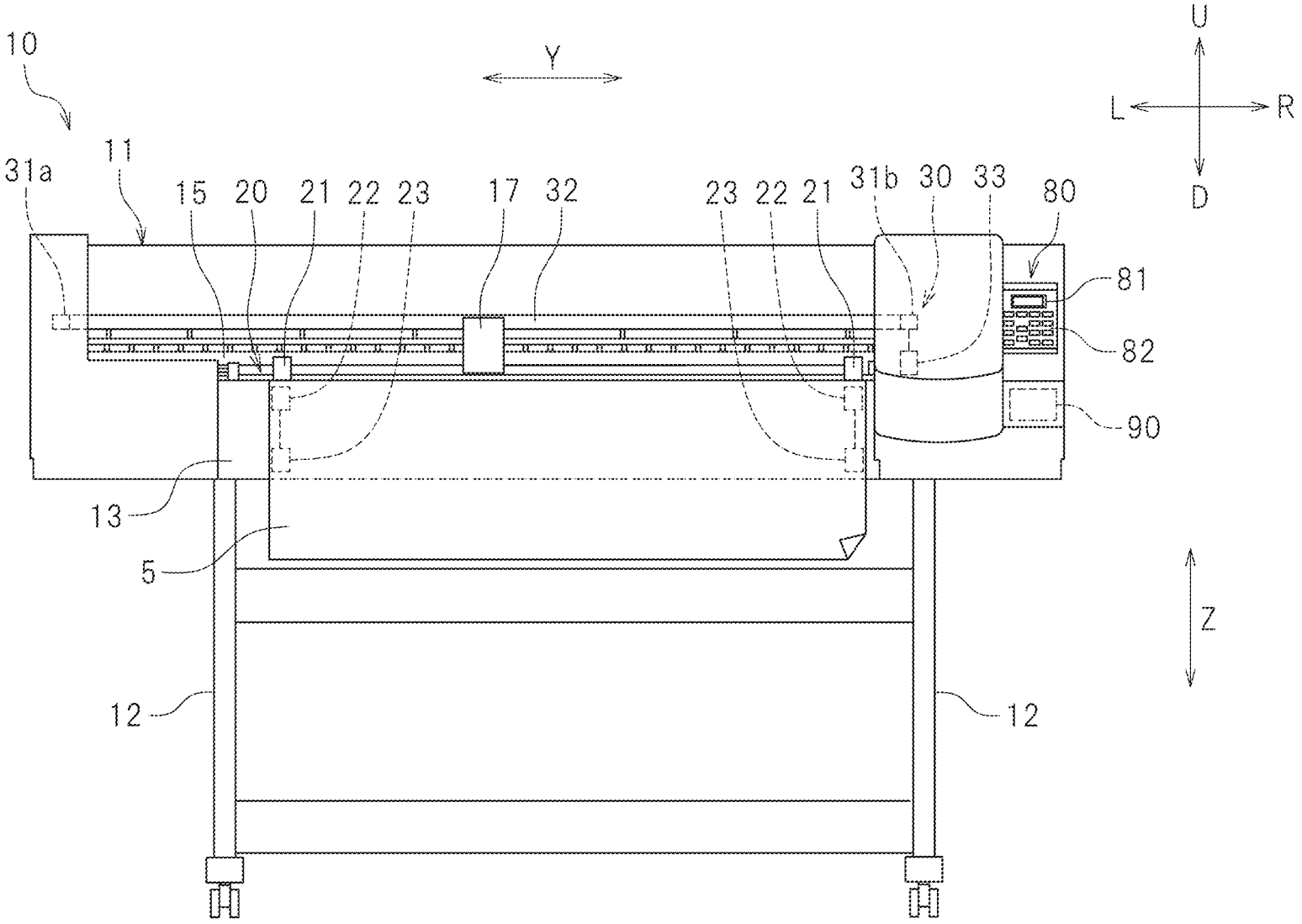
FIG. 1 is a front view of a printer according to a preferred embodiment of the present invention.
Figure 2:
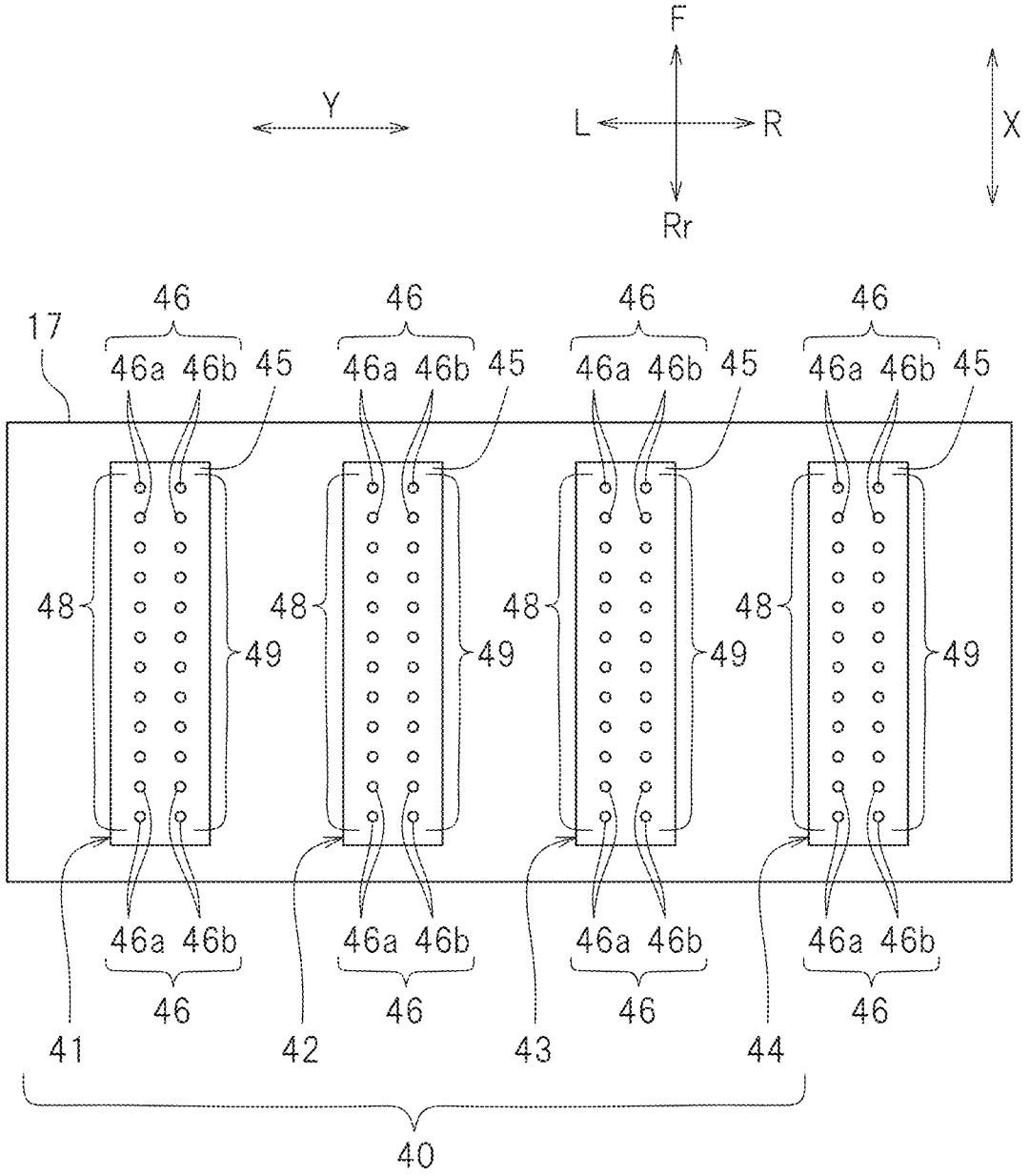
FIG. 2 is a bottom view schematically showing a structure of bottom surfaces of a carriage and ink heads.
Figure 3:
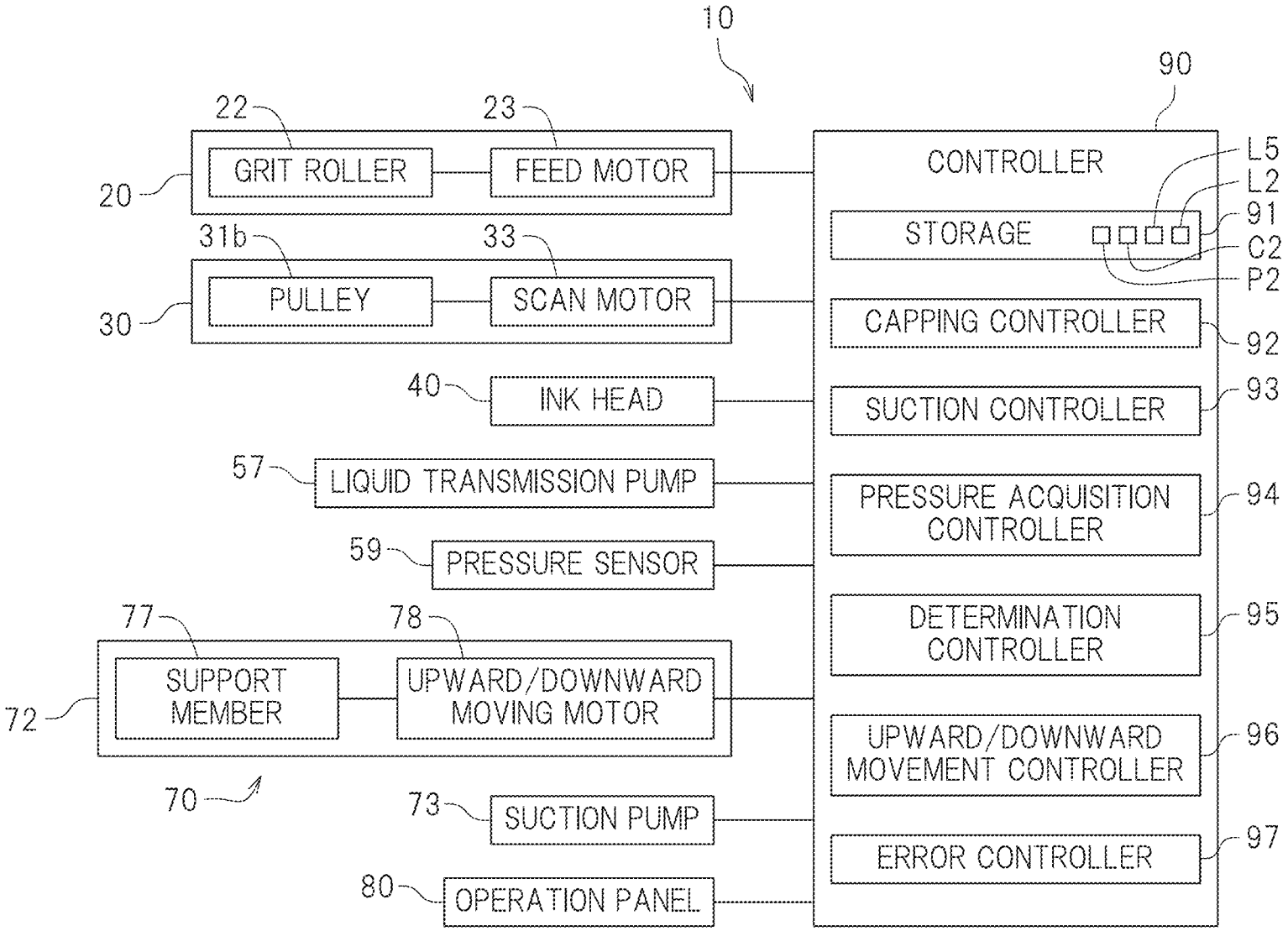
FIG. 3 is a block diagram of the printer according to the present preferred embodiment of the present invention.

Hereinafter, an inkjet printer (hereinafter, referred to as a "printer") 10 according to a preferred embodiment of the present invention will be described. FIG. 1 is a front view showing the printer 10 according to the present preferred embodiment. FIG. 2 is a bottom view schematically showing a structure of bottom surfaces of a carriage 17 and ink heads 40 of the printer 10. FIG. 3 is a block diagram of the printer 10 according to this preferred embodiment. In the figures, letters F, Rr, L, R, U and D respectively represent "front", "rear", "left", "right", "up" and "down" regarding the printer 10. In the figures, letter Y represents a main scanning direction. In this preferred embodiment, the main scanning direction Y is a left-right direction. In the figures, letter X represents a sub scanning direction. In this preferred embodiment, the sub scanning direction X is a front-rear direction, and crosses (perpendicularly crosses in this example) the main scanning direction Y as seen in a plan view. In the figures, letter Z represents an up-down direction. It should be noted that these directions are defined for the sake of convenience, and do not limit the manner of installation of the printer 10 in any way, or does not limit the present invention in any way.

The printer 10 is an inkjet printer. The printer 10 performs printing on a medium 5 shown in FIG. 1. The medium 5 is, for example, a roll-type recording sheet, namely, a so-called recording paper roll. The medium 5 is not limited to such a roll-type recording sheet. The medium 5 may be, for example, paper such as plain paper, inkjet printing paper or the like; a resin sheet or film of poly(vinylchloride), polyester or the like; a plate; cloth such as woven cloth, unwoven cloth or the like; or any other appropriate material.

As shown in FIG. 1, the printer 10 includes a printer main body 11, a platen 13, a transportation mechanism 20, a guide rail 15, the carriage 17, a head moving mechanism 30, the ink heads (see FIG. 2), ink supply units 50 (see FIG. 4), a cap unit 70 (see FIG. 6), and a controller 90.

The printer main body 11 includes a casing extending in the main scanning direction Y. The printer main body 11 is supported by legs 12. The legs 12 are provided on a bottom surface of the printer main body 11, and extend downward from the bottom surface.

The platen 13 supports the medium 5. In this preferred embodiment, the medium 5 is placed on the platen 13. On the platen 13, the printing is performed on the medium 5. The platen 13 spreads in the main scanning direction Y and the sub scanning direction X.

The medium 5 supported by the platen 13 is transported in the sub scanning direction X by the transportation mechanism 20. There is no specific limitation on the structure of the transportation mechanism 20. In this preferred embodiment, the transportation mechanism 20 includes pinch rollers 21, grit rollers 22, and feed motors 23. The pinch rollers 21 are provided above the platen 13 and below the guide rail 15, and press the medium 5 from above. The pinch rollers 21 are located to the rear of the carriage 17 as seen in a plan view. The grit rollers 22 are provided in the platen 13, and each have a cylindrical outer shape. The grit rollers 22 are buried in the platen 13 with top surfaces thereof being exposed. The grit rollers 22 respectively face the pinch rollers 21. The grit rollers 22 are respectively connected with the feed motors 23.

When the feed motors 23 are driven in a state where the medium 5 is held between the pinch rollers 21 and the grit rollers 22, the grit rollers 22 rotate. As a result, the medium 5 on the platen 13 is transported in the sub scanning direction X.

The guide rail 15 is located above the platen 13. The guide rail 15 is located parallel to the platen 13, and extends in the main scanning direction Y. The guide rail 15 is in engagement with the carriage 17. The carriage 17 is provided to be slidable along the guide rail 15, and is movable in the main scanning direction Y.

The head moving mechanism 30 moves the carriage 17 and the ink heads 40 (see FIG. 2) in the main scanning direction Y with respect to the medium 5 supported by the platen 13. In this preferred embodiment, the head moving mechanism 30 moves the carriage 17 and the ink heads 40 in the main scanning direction Y. There is no specific limitation on the structure of the head moving mechanism 30.

In this preferred embodiment, as shown in FIG. 1, the head moving mechanism 30 includes left and right pulleys 31*a* and 31*b*, a belt 32, and a scan motor 33. The left pulley 31*a* is provided around a left end portion of the guide rail 15. The right pulley 31*b* is provided around a right end portion of the guide rail 15. The belt 32 is an endless belt, and is wound around the left and right pulleys 31*a* and 31*b*. The carriage 17 is attached and fixed to the belt 32. The right pulley 31*b* is connected with the scan motor 33.

In this preferred embodiment, the scan motor 33 is driven to rotate the right pulley 31*b*, and thus the belt 32 runs. As a result, the carriage 17 and the ink heads 40 move in the main scanning direction Y along the guide rail 15.

As shown in FIG. 2, the ink heads 40 are provided in the carriage 17. The ink heads 40 are supported by the carriage 17, such that bottom surfaces thereof are exposed. There is no specific limitation on the number of the ink heads 40. In this preferred embodiment, there are four ink heads 40, for example. The four ink heads 40 are located in a line in the main scanning direction Y.

In the following description, the four ink heads 40 may also be referred to as a first ink head 41, a second ink head 42, a third ink head 43 and a fourth ink head 44 from the left to the right. The ink heads 40 include the first ink head 41, the second ink head 42, the third ink head 43 and the fourth ink head 44. In the following description, the expression the "ink head 40" or the "ink heads 40" will be used for an explanation common to all the first through fourth ink heads 41 through 44.

The ink heads 40 (more specifically, the first through fourth ink heads 41 through 44) respectively have nozzle surfaces 45. The nozzle surfaces 45 each define a bottom surface of the ink head 40. Nozzles 46 are provided in each of the nozzle surfaces 45. The nozzles 46 include a plurality of first nozzles 46*a* and a plurality of second nozzles 46*b*. The plurality of first nozzles 46*a* are provided in the nozzle surface 45 and located in a line in the sub scanning direction X. The plurality of second nozzles 46*b* are also provided in the nozzle surface 45 and located in a line in the sub scanning direction X.

Regarding each nozzle surface 45, the line of the plurality of first nozzles 46*a* will be referred to as a "first nozzle line 48", and the line of the plurality of second nozzles 46*b* will be referred to as a "second nozzle line 49". The nozzle lines 48 and 49 are located in a line in the main scanning direction Y. The first through fourth ink heads 41 through 44 each include the two nozzle lines 48 and 49. In this preferred embodiment, there are eight nozzle lines in total (the sum of the first nozzle lines 48 and the second nozzle lines 49), for example.

Figure 4:
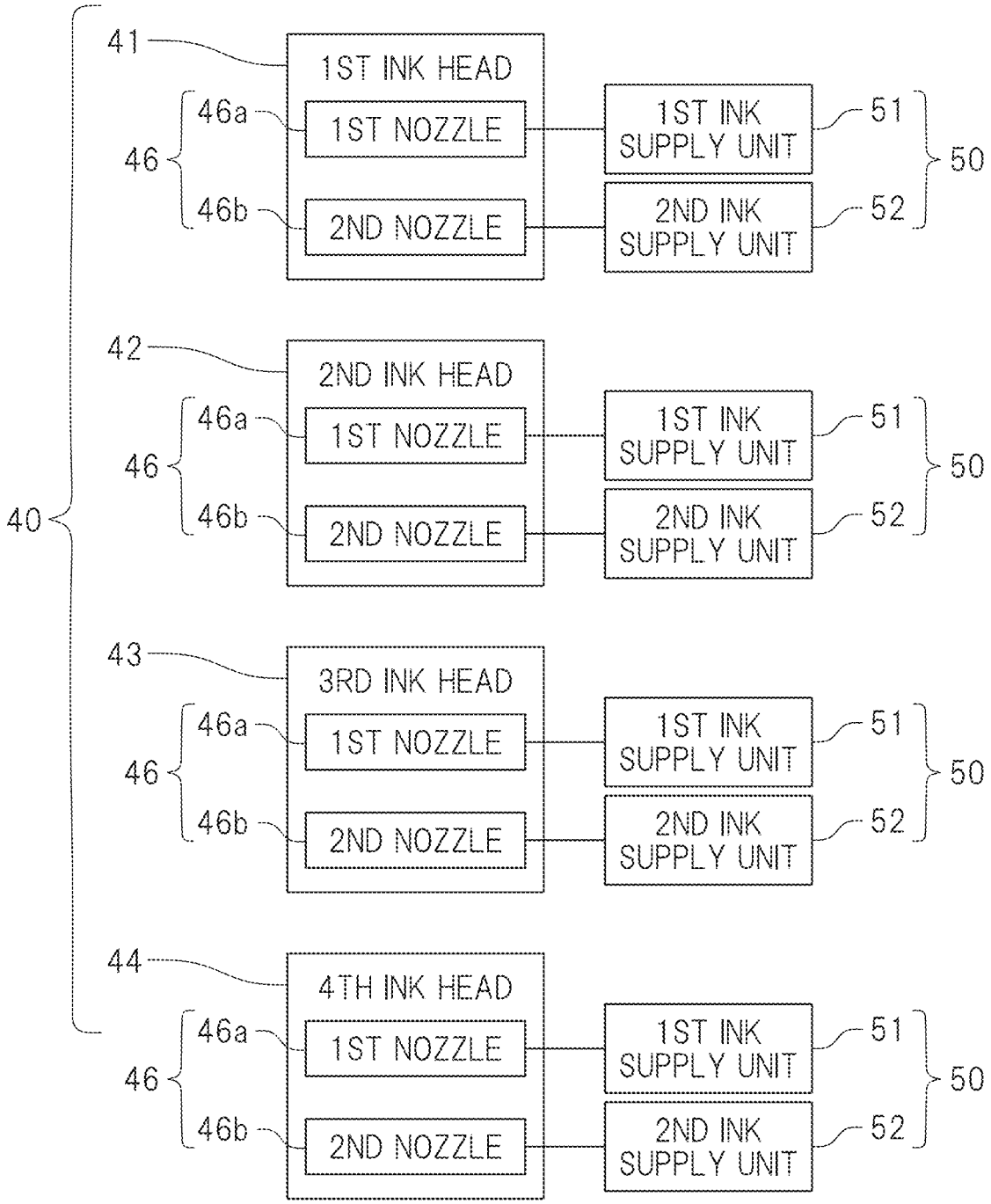
FIG. 4 is a conceptual view showing the relationship between the ink heads and ink supply units.

FIG. 4 is a conceptual view showing the relationship between the ink heads 40 and the ink supply units 50. In this preferred embodiment, the ink supply units 50 shown in FIG. 4 supply ink to the ink heads 40 (for example, the nozzles 46). The ink supply units 50 are connected with the nozzles 46 of the ink heads 40. In this preferred embodiment, the ink supply units 50 include first ink supply units 51 supplying ink to the first nozzles 46*a* of the ink heads 40 and second ink supply units 52 supplying ink to the second nozzles 46*b* of the ink heads 40. The ink supply units 51 and 52 are connected with the first through fourth ink heads 41 through 44. The number of the first ink supply units 51 is equal to the number of the first nozzle lines 48 (see FIG. 2) including the first nozzles 46*a*, namely, four. The number of the second ink supply units 52 is equal to the number of the second nozzle lines 49 (see FIG. 2) including the second nozzles 46*b*, namely, four. Therefore, there are eight ink supply units 50 in this preferred embodiment, for example.

Figure 5:
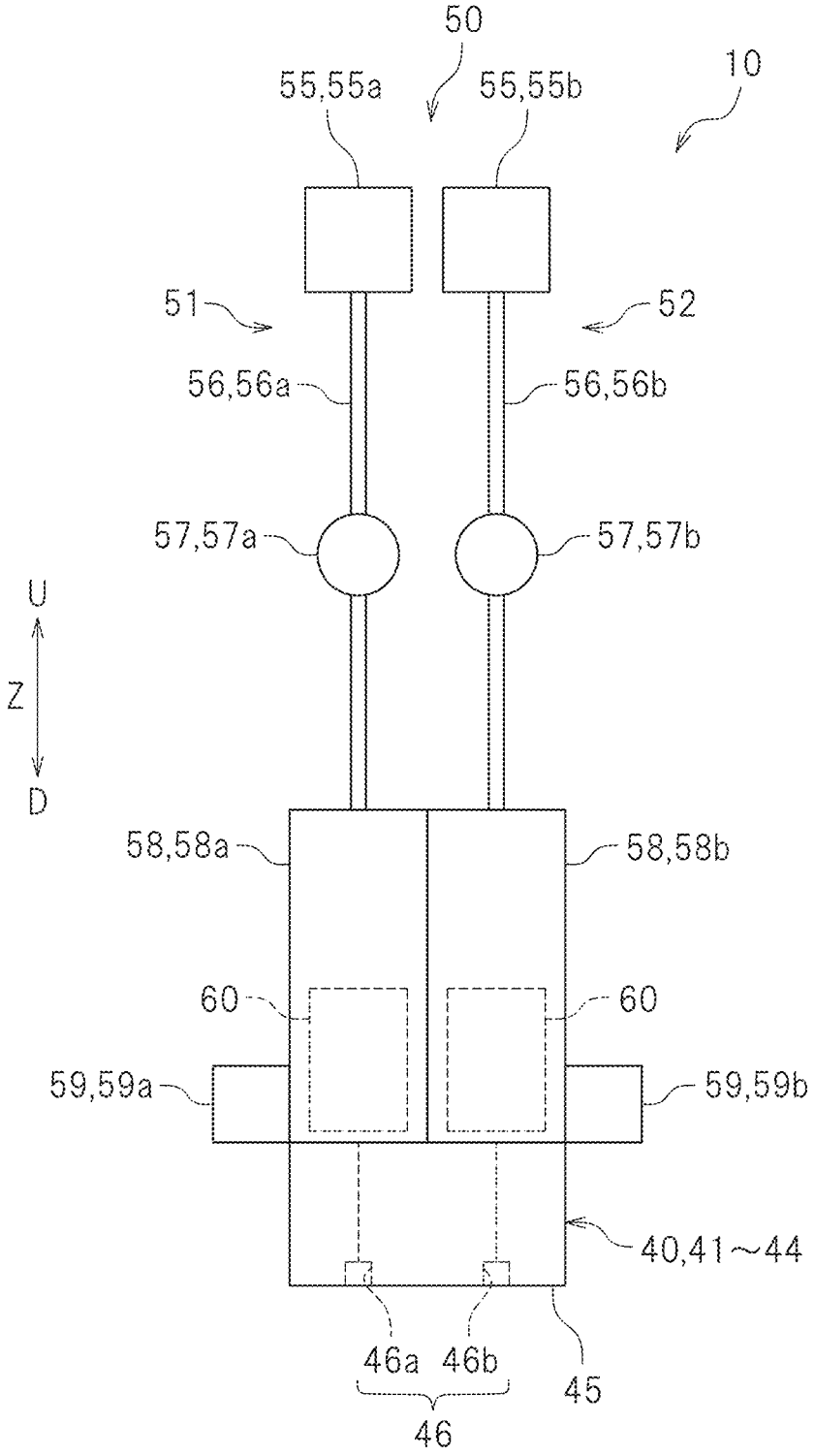
FIG. 5 is a schematic front view showing a structure of one ink head and the ink supply units corresponding thereto.

FIG. 5 is a schematic front view showing a structure of one ink head 40 and the ink supply units 50 corresponding thereto. The ink supply units 50 include ink tanks 55, ink supply paths 56, liquid transmission pumps 57, dampers 58, and pressure sensors 59. The ink tanks 55 are each a container accommodating ink. The ink tanks 55 may each be, for example, a cartridge or a pouch-shaped item.

The ink accommodated in each of the ink tanks 55 is, for example, one of process color ink and special color ink. Process color ink includes, for example, cyan ink, magenta ink, yellow ink, black ink, and the like. The special color ink includes ink of colors other than those of the process color ink. The special color ink includes, for example, white ink, clear ink, gloss ink, primer ink, fluorescent ink, metallic ink, orange ink, red ink, violet ink, blue ink, green ink, and the like. It should be noted that there is no specific limitation on the color of the ink accommodated in each of the ink tanks 55. There is no specific limitation on the material of the ink. The ink may be formed of any of various materials conventionally used as a material of the ink for an inkjet printer. The ink may be, for example, solvent-based pigment ink or aqueous pigment ink. Alternatively, the ink may be aqueous dye ink, ultraviolet-curable ink, which is cured by being irradiated with ultraviolet rays, or the like.

In this preferred embodiment, the ink tanks 55 include a first ink tank 55*a* and a second ink tank 55*b*, for example. The first ink tank 55*a* is included in the first ink supply unit 51, and is connected with the first nozzles 46*a*. The second ink tank 55*b* is included in the second ink supply unit 52, and is connected with the second nozzles 46*b*.

The ink supply paths 56 are each a flow path connecting the ink tank 55 and the ink head 40. One end of each ink supply path 56 is connected with the ink tank 55, and the other end of each ink supply path 56 is connected with the ink head 40. There is no specific limitation on the structure of the ink supply paths 56. The ink supply paths 56 are each formed of, for example, a flexible tube. The ink in the ink tanks 55 flows in the ink supply paths 56 and is supplied to the ink head 40.

In this preferred embodiment, the ink supply paths 56 include a first ink supply path 56*a* and a second ink supply path 56*b*. The first ink supply path 56*a* is included in the first ink supply unit 51, and the second ink supply path 56*b* is included in the second ink supply unit 52. One end of the first ink supply path 56*a* is connected with the first ink tank 55*a*, and the other end of the first ink supply path 56*a* is connected with the first nozzles 46*a* of the ink head 40. The ink accommodated in the first ink tank 55*a* is supplied to the first nozzles 46*a* via the first ink supply path 56*a*. One end of the second ink supply path 56*b* is connected with the second ink tank 55*b*, and the other end of the second ink supply path 56*b* is connected with the second nozzles 46*b* of the ink head 40. The ink accommodated in the second ink tank 55*b* is supplied to the second nozzles 46*b* via the second ink supply path 56*b*.

The liquid transmission pumps 57 are provided in the ink supply paths 56. The liquid transmission pumps 57 are each a pump supplying the ink accommodated in the ink tank 55 to the ink head 40 and adjusting the pressure of the ink to a pressure suitable to the injection thereof from the ink head 40. When being driven, the liquid transmission pumps 57 transmit the ink from the ink tanks 55 toward the ink head 40. There is no specific limitation on the type of the liquid transmission pumps 57. The liquid transmission pumps 57 are each, for example, a diaphragm pump, a tube pump, or the like.

In this preferred embodiment, the liquid transmission pumps 57 include a first liquid transmission pump 57*a* and a second liquid transmission pump 57*b*. The first liquid transmission pump 57*a* is included in the first ink supply unit 51. The first liquid transmission pump 57*a* is provided in the first ink supply path 56*a*, and transmits the ink from the first ink tank 55*a* toward the first nozzles 46*a* of the ink head 40. The second liquid transmission pump 57*b* is included in the second ink supply unit 52. The second liquid transmission pump 57*b* is provided in the second ink supply path 56*b*, and transmits the ink from the second ink tank 55*b* toward the second nozzles 46*b* of the ink head 40.

The dampers 58 alleviate a change in the pressure of the ink to stabilize the injection of the ink from the ink head 40. The driving of the liquid transmission pumps 57 is controlled in accordance with, for example, the flow rate of the ink flowing into the dampers 58 (in other words, in accordance with the pressures in the dampers 58). The dampers 58 are connected with the ink head 40 (in this preferred embodiment, the nozzles 46). In this preferred embodiment, the dampers 58 are provided above the ink head 40.

In this preferred embodiment, the dampers 58 include a first damper 58*a* and a second damper 58*b*. The first damper 58*a* is included in the first ink supply unit 51, and is connected with the first nozzles 46*a* of the ink head 40. The second damper 58*b* is included in the second ink supply unit 52, and is connected with the second nozzles 46*b* of the ink head 40. The first damper 58*a* and the second damper 58*b* are located in a line above the ink head 40.

There is no specific limitation on the structure of the dampers 58 (more specifically, the first damper 58*a* and the second damper 58*b*). In this preferred embodiment, the dampers 58 each include an ink chamber 60 temporarily storing the ink. The ink chamber 60 expands or contracts in accordance with the amount of the ink stored therein. In this preferred embodiment, the pressure in the ink chamber 60 changes in accordance with the amount of the ink stored therein. When, for example, the amount of ink in the ink chamber 60 is increased, the ink chamber 60 expands and the pressure therein is increased. By contrast, when the amount of the ink in the ink chamber 60 is decreased, the ink chamber 60 contracts and the pressure therein is decreased. The ink chamber 60 is in communication with the ink supply path 56 and the ink head 40. Although not shown, the ink chamber 60 has an inlet and an outlet formed therein. The ink chamber 60 is connected with the ink supply path 56 via the inlet, and is connected with the ink head 40 via the outlet.

In this preferred embodiment, the ink chamber 60 of the first damper 58*a* is in communication with the first ink supply path 56*a* and the first nozzles 46*a* of the ink head 40. The ink chamber 60 of the second damper 58*b* is in communication with the second ink supply path 56*b* and the second nozzles 46*b* of the ink head 40.

The pressure sensors 59 detect the pressures in the dampers 58. The expression the "pressures in the dampers 58" refers to the pressures in the ink chambers 60 included in the dampers 58. The pressure sensors 59 each detect the pressure in the corresponding damper 58 based on, for example, the size of the ink chamber 60 (e.g., the degree at which the ink chamber 60 expands or contracts).

In this preferred embodiment, the pressure sensors 59 include a first pressure sensor 59*a* and a second pressure sensor 59*b*. The first pressure sensor 59*a* is included in the first ink supply unit 51, and detects the pressure in the first damper 58*a*. The second pressure sensor 59*b* is included in the second ink supply unit 52, and detects the pressure in the second damper 58*b*.

Figure 6:
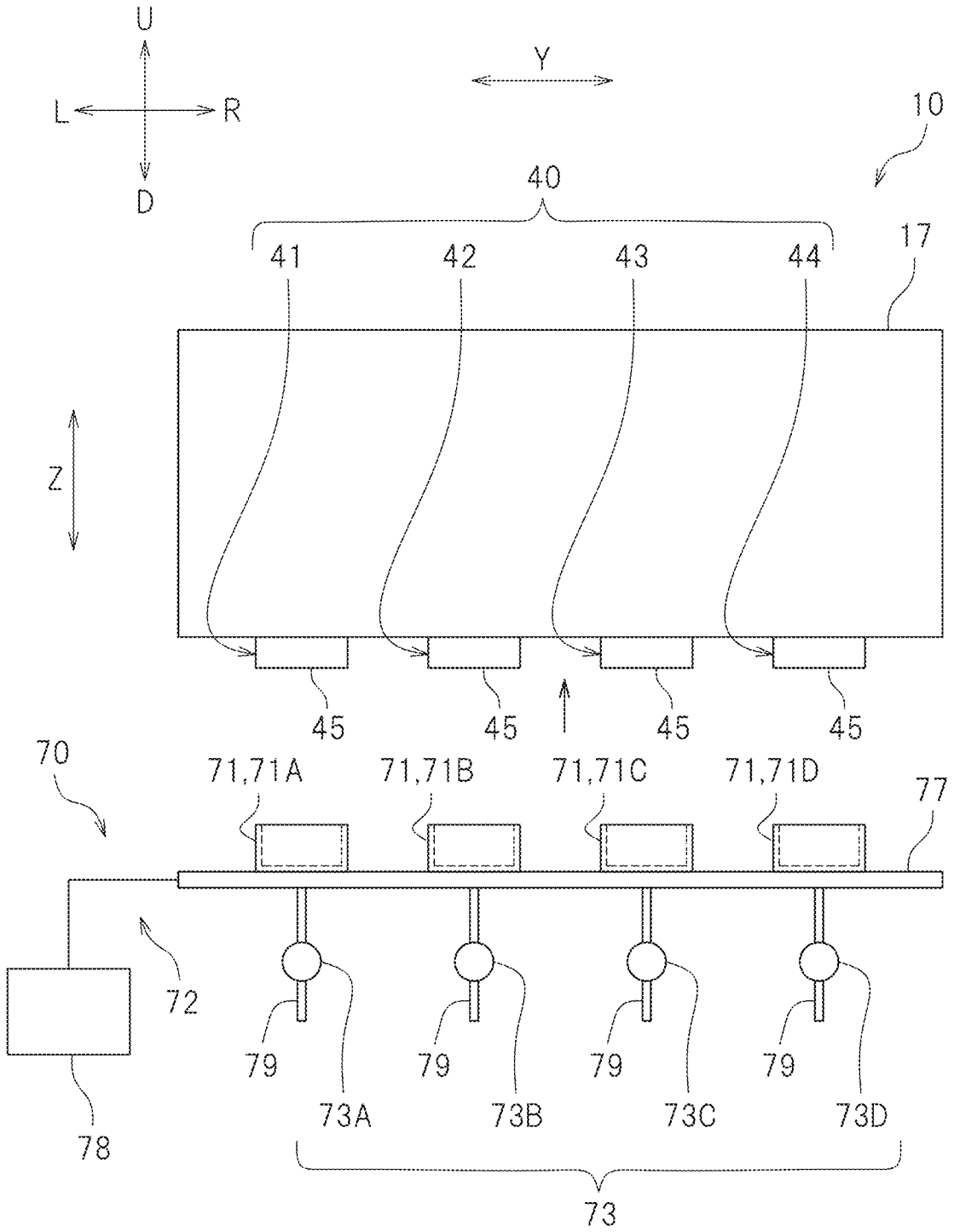
FIG. 6 is a front view showing the carriage, the ink heads and a cap unit.
Figure 7:
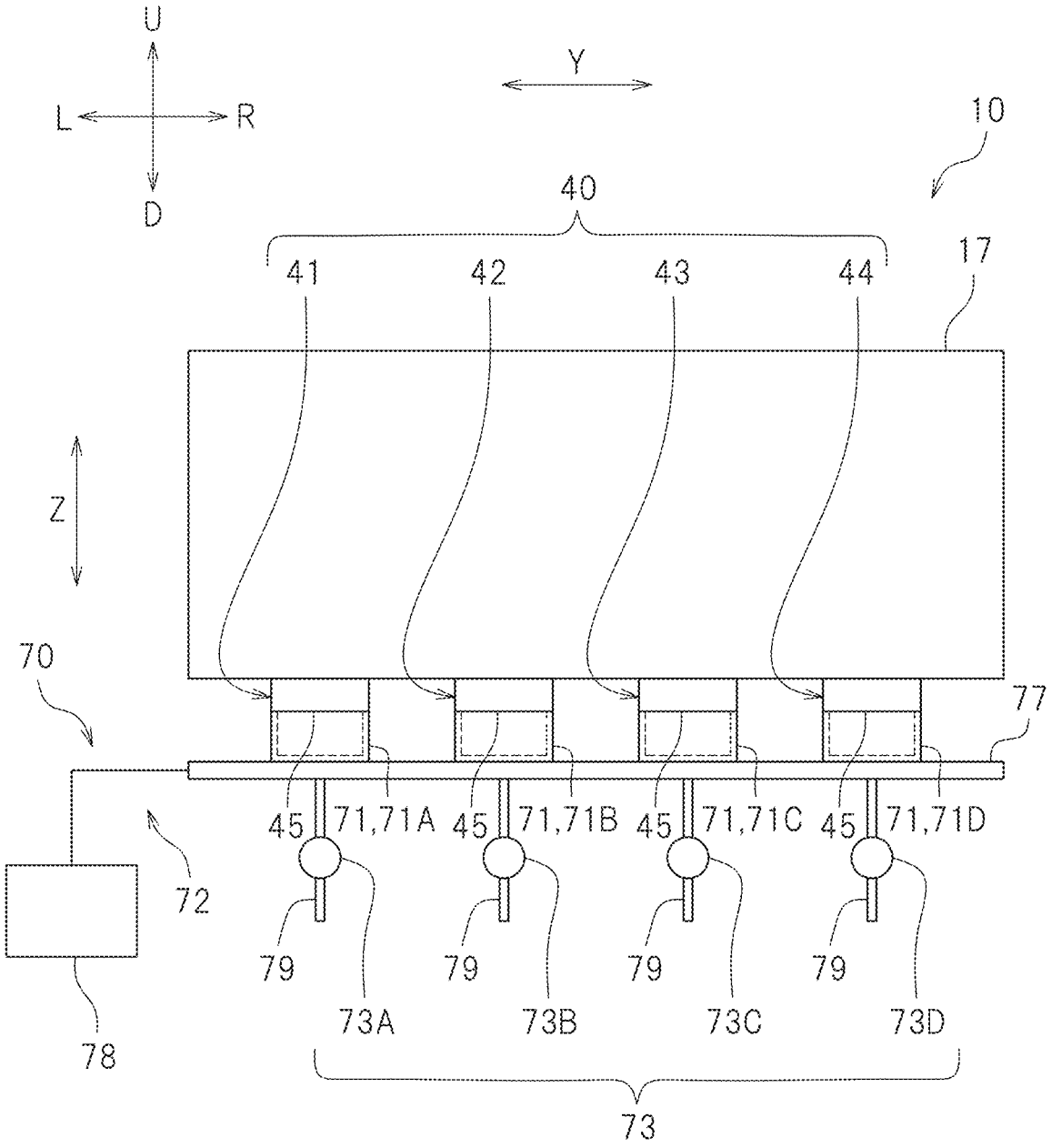
FIG. 7 is a front view showing the carriage, the ink heads and the cap unit.
Figure 8:
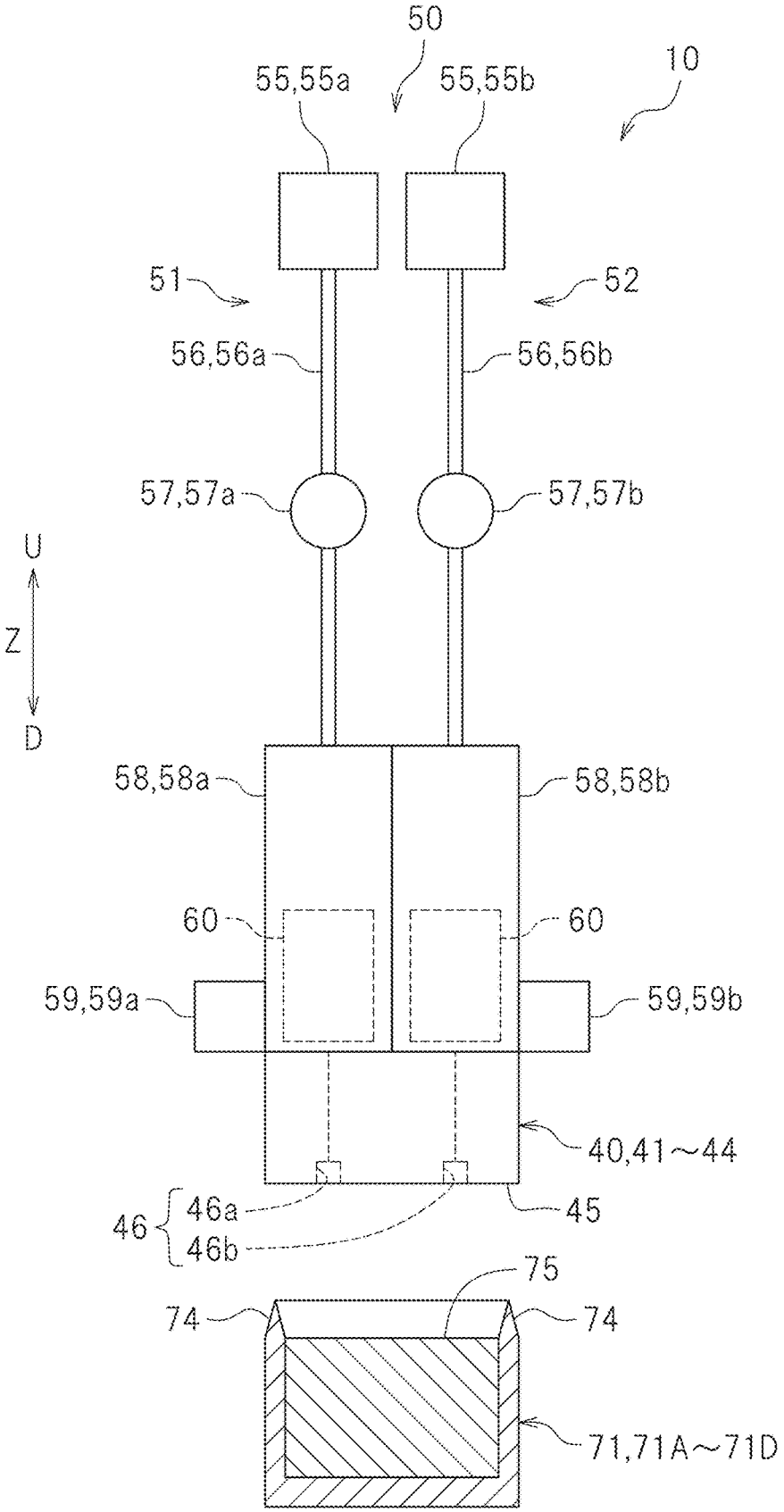
FIG. 8 is a schematic front view showing one ink head, the ink supply units corresponding thereto, and one cap corresponding thereto in a state where the cap is separated from the ink head.
Figure 9:
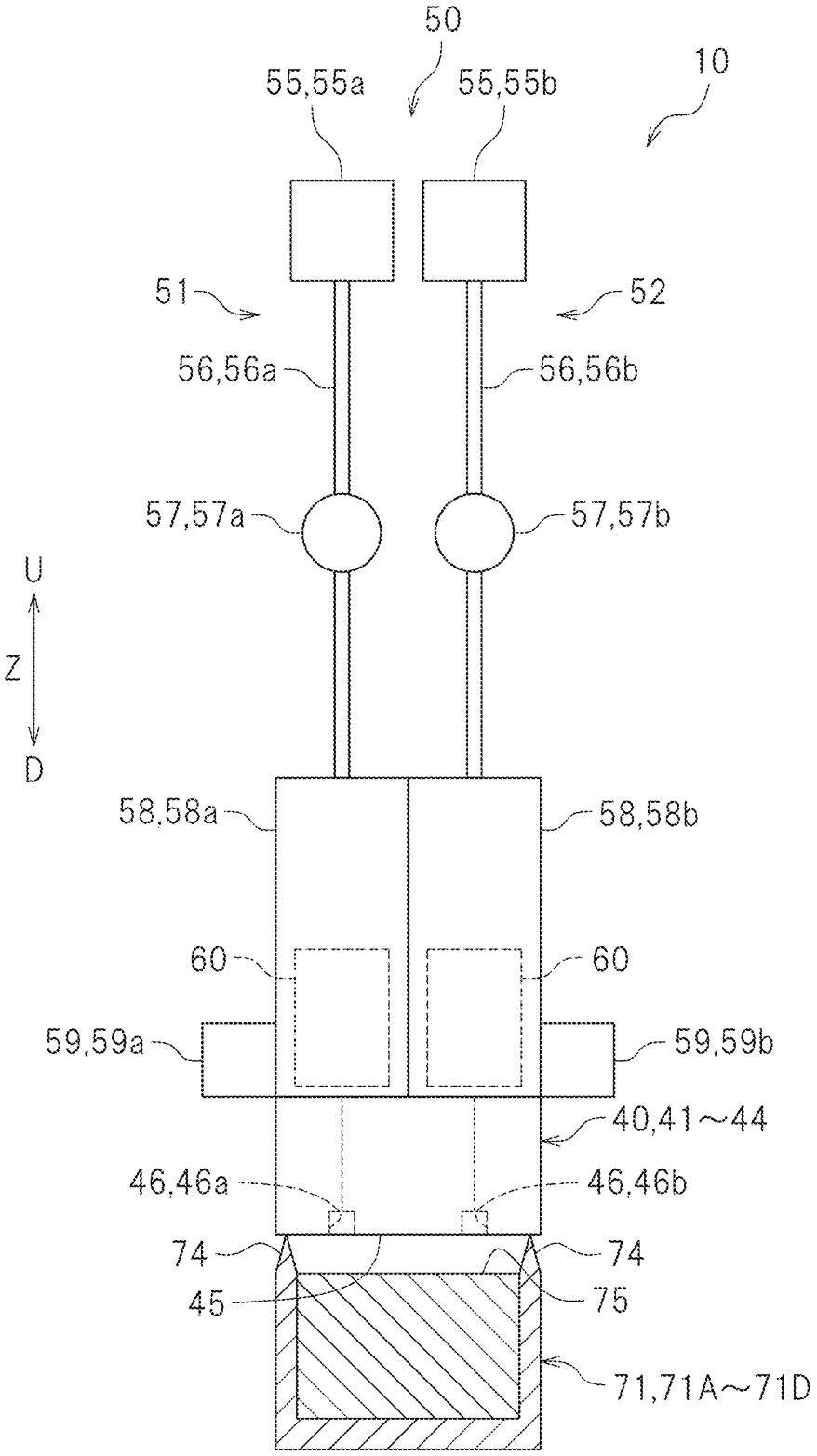
FIG. 9 is a schematic front view showing one ink head, the ink supply units corresponding thereto, and one cap corresponding thereto in a state during a suction process.

Now, the cap unit 70 will be described. FIG. 6 and FIG. 7 are each a front view showing the carriage 17, the ink heads 40 and the cap unit 70. FIG. 8 and FIG. 9 are each a schematic front view showing one ink head 40, the ink supply units 50 corresponding thereto, and one cap 71 corresponding thereto. As shown in FIG. 6, the cap unit 70 includes a plurality of caps 71, an upward/downward moving mechanism 72, and a plurality of suction pumps 73.

The caps 71 are attachable to the ink heads 40 so as to cover the nozzles 46 (see FIG. 2). One cap 41 is attachable to one ink head 40. Therefore, the number of the caps 71 is equal to the number of the ink heads 40, namely, four. In this preferred embodiment, the caps 71 include a first cap 71A, a second cap 71B, a third cap 71C, and a fourth cap 71D. As shown in FIG. 7, the first cap 71A, the second cap 71B, the third cap 71C and the fourth cap 71D are respectively attachable to the first ink head 41, the second ink head 42, the third ink head 43 and the fourth ink head 44. In the following description, the expression "the cap 71" or "the caps 71" will be used for an explanation common to all the first through fourth caps 71A through 71D.

In this preferred embodiment, as shown in FIG. 8, the caps 71 each include a lip portion 74. The lip portion 74 forms a top end portion of the cap 71. As shown in FIG. 9, the lip portion 74 is in contact with the nozzle surface 45 in a state where the cap 71 is attached to the ink head 40. The lip portion 74 is ring-shaped. The lip portion 74 has a width decreasing as being closer to a top end thereof. The "width of the lip portion 74" is a length of the lip portion 74 in a direction perpendicular to a circumferential direction thereof. The lip portion 74 tapers off toward the top end thereof.

The lip portion 74 is elastically deformable. Therefore, the lip portion 74 may be elastically deformed when contacting the nozzle surface 45 of the ink head 40. There is no specific limitation on the material of the lip portion 74. In this preferred embodiment, the lip portion 74 is formed of rubber. Specifically, the lip portion 74 is formed of ethylene propylene diene monomer (EPDM) or butyl rubber. In this preferred embodiment, the portion of the cap 71 except for the lip portion 74 is also formed of rubber.

In the cap 71, an absorber 75 is provided. The absorber 75 is accommodated in the cap 71. The absorber 75 receives the ink injected (or discharged) from the ink head 40 into the cap 71. The ink received by the absorber 75 is absorbed into the absorber 75. The absorber 75 is located below the top end of the lip portion 74, and the lip portion 74 protrudes upward from the absorber 75. The absorber 75 may be formed of any material that absorbs ink with no specific limitation. In this preferred embodiment, the absorber 75 is formed of a porous material. The absorber 75 is formed of, for example, sponge formed of poly(vinylalcohol) (i.e., PVA sponge).

As shown in FIG. 6 and FIG. 7, the upward/downward moving mechanism 72 moves the cap 71 upward and downward with respect to the ink head 40. In this preferred embodiment, the upward/downward moving mechanism 72 moves the caps 71 (more specifically, the first through fourth caps 71A through 71D) upward and downward. The upward/downward moving mechanism 72 attaches the caps 71 to the ink heads 40 or separates the caps 71 from the ink heads 40. For example, the upward/downward moving mechanism 72 moves the caps 71 upward as represented by the arrow in FIG. 6 to attach the caps 71 to the ink heads 40 as shown in FIG. 7. The upward/downward moving mechanism 72 moves the caps 71 downward to separate the caps 71 from the ink heads 40 as shown in FIG. 6.

There is no specific limitation on the structure of the upward/downward moving mechanism 72. In this preferred embodiment, the upward/downward moving mechanism 72 includes a support member 77 and an upward/downward moving motor 78. The support member 77 is, for example, a plate-shaped member extending in the main scanning direction Y and the sub scanning direction X, and supports the first through fourth caps 71A through 71D. The upward/downward moving motor 78 is connected with the support member 77. In this preferred embodiment, the upward/downward moving motor 78 is driven, and as a result, the support member 77 moves upward or downward. Along with the upward or downward movement of the support member 77, the first through fourth caps 71A through 71D move upward or downward collectively at the same time. The upward or downward movement of the first through fourth caps 71A through 71D allows the caps 71 to be attached to the nozzle surfaces 45 collectively or to be separated from the nozzle surfaces 45 collectively.

The suction pumps 73 are respectively connected with the caps 71. The suction pumps 73 each suction the ink in the cap 71 connected therewith, or the ink in the ink head 40 to which the cap 71 connected therewith is attached. In this preferred embodiment, one suction pump 73 is connected with one cap 71. Therefore, the number of the suction pumps 73 is equal to the number of the caps 71, namely, four. In this preferred embodiment, the suction pumps 73 include a first suction pump 73A, a second suction pump 73B, a third suction pump 73C, and a fourth suction pump 73D. The first suction pump 73A, the second suction pump 73B, the third suction pump 73C and the fourth suction pump 73D are respectively connected with the first cap 71A, the second cap 71B, the third cap 71C and the fourth cap 71D. In the following description, the expression the "suction pump 73" or the "suction pumps 73" will be used for an explanation common to all the first through fourth suction pumps 73A through 73D.

In this preferred embodiment, there is no specific limitation on the type of the suction pumps 73. The suction pumps 73 are each, for example, a vacuum pump. The suction pumps 73 are respectively provided in the middle of tubes 79. One end of each of the tubes 79 is connected with the cap 71 corresponding thereto, and the other end of each of the tubes 79 is connected with a waste liquid tank (not shown). The waste liquid tank is provided in the number of, for example, one, and is connected with the first through fourth caps 71A through 71D via the four tubes 79.

When, for example, any one suction pump 73 is driven in a state where the cap 71 is attached to the ink head 40, the pressure in the cap 71 becomes lower than a negative pressure in the ink supply path 56 connected with the ink head 40 as shown in FIG. 9. As a result, the ink is suctioned out of the nozzles 46 (in this preferred embodiment, the first nozzles 46*a* and the second nozzles 46*b*), and the ink in the ink head 40 is discharged into the cap 71. The ink in the cap 71 suctioned by the suction pump 73 is discharged into the waste liquid tank via the tube 79.

In this preferred embodiment, as shown in FIG. 1, an operation panel 80 is provided at a right end of the printer main body 11 of the printer 10. The operation panel 80 includes a display screen 81 displaying the state of the printer 10, input keys 82 operable by a user, and the like.

Now, the controller 90 will be described. The controller 90 is configured or programmed to perform controls on the printing and a control of suctioning the ink in the ink heads 40, and the like. There is no specific limitation on the structure of the controller 90. The controller 90 is, for example, a microcomputer. There is no specific limitation on the hardware structure of the microcomputer. The controller 90 includes, for example, an I/F, a CPU, a ROM, and a RAM. The controller 90 is provided in the printer main body 11. It should be noted that the controller 90 may be realized by, for example, a computer installed outside the printer main body 11. In this case, the controller 90 is communicably connected with a control board (not shown) of the printer 10 in a wired or wireless manner.

In this preferred embodiment, as shown in FIG. 3, the controller 90 is communicably connected with the transportation mechanism 20 (more specifically, the feed motors 23), the head moving mechanism 30 (more specifically, the scan motor 33), the ink heads 40 (more specifically, the first through fourth ink heads 41 through 44 (see FIG. 2)), the liquid transmission pumps 57 (more specifically, the first liquid transmission pumps 57*a* and the second liquid transmission pumps 57*b* (see FIG. 5)), the pressure sensors 59 (more specifically, the first pressure sensors 59*a* and the second pressure sensors 59*b* (see FIG. 5)), the upward/downward moving mechanism 72 of the camp unit 70 (more specifically, the upward/downward moving motor 78), the suction pumps 73 of the camp unit 70 (more specifically, the first through fourth suction pumps 73A through 73D (see FIG. 6)), and the operation panel 80. The controller 90 is configured or programmed to control the transportation mechanism 20, the head moving mechanism 30, the ink heads 40, the liquid transmission pumps 57, the pressure sensors 59, the upward/downward moving mechanism 72, the suction pumps 73 and the operation panel 80.

In the printer 10 according to this preferred embodiment, a cleaning process is executed on the ink heads 40 in order to suppress generation of abnormal injection from the nozzles 46 in the ink heads 40. The "abnormal injection from the nozzles 46" refers abnormalities such that the ink injected from the nozzles 46 frays, that the ink is not injected from the nozzles 46, and the like; namely, abnormalities that deteriorate the quality of the printing.

The cleaning process includes a suction process. The suction process refers to a process of suctioning the ink from the nozzles 46 in a state where the cap 71 is attached to the ink head 40 as shown in FIG. 9.

In this preferred embodiment, as shown in FIG. 3, the controller 90 includes a storage 91, a capping controller 92, a suction controller 93, a pressure acquisition controller 94, a determination controller 95, an upward/downward movement controller 96, and an error controller 97 in order to execute the suction process. The controllers and the like 91 through 97 of the controller 90 may be realized by software or hardware. The controllers and the like 91 through 97 of the controller 90 may be realized by one or a plurality of processors or may be incorporated into a circuit.

Now, a control procedure to execute the suction process by the printer 10 according to this preferred embodiment will be described with reference to the flowchart shown in FIG. 10.

Figure 10:
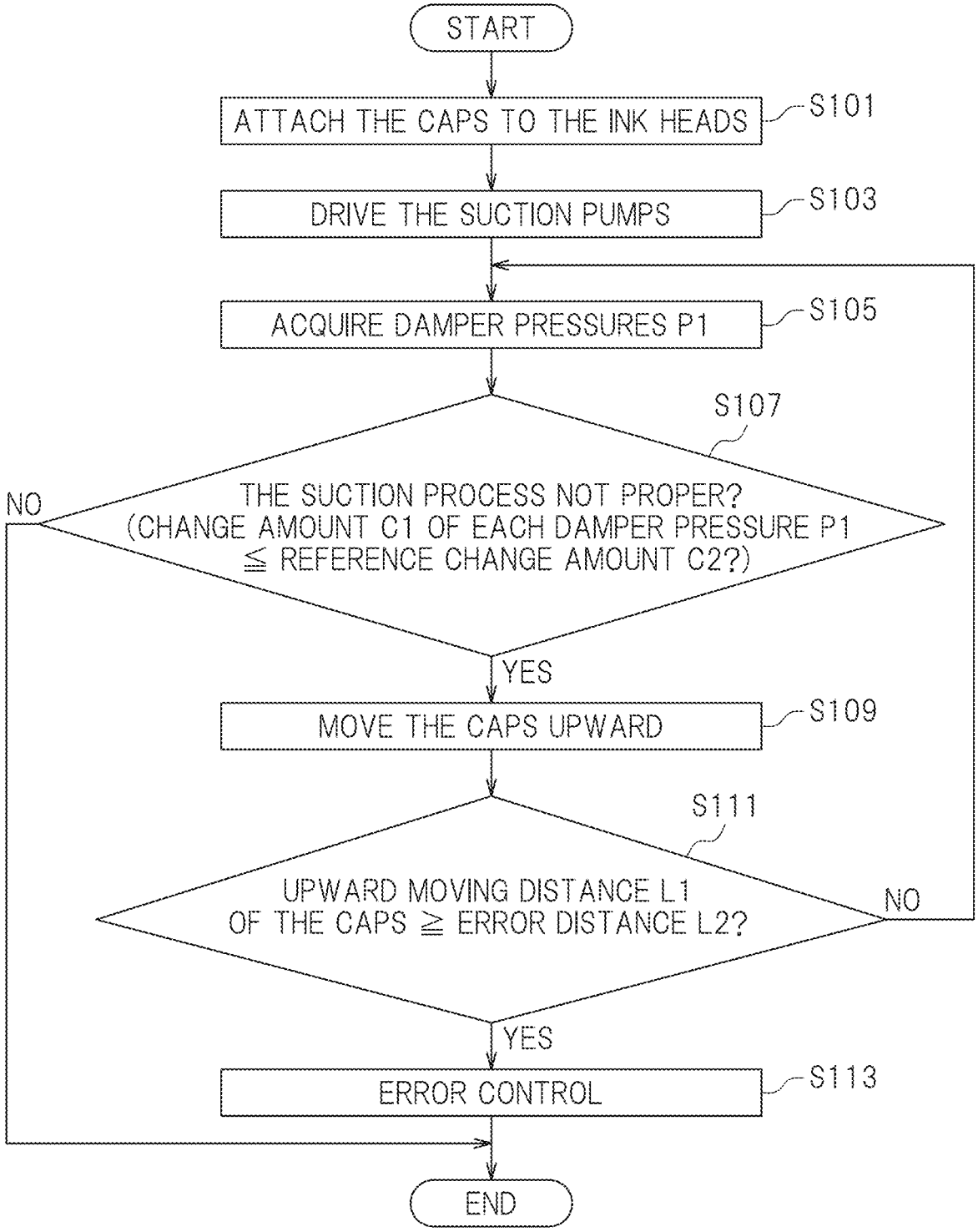
FIG. 10 is a flowchart showing a control procedure of the suction process.

Referring to FIG. 10, in step S101, the capping controller 92 shown in FIG. 3 controls the upward/downward moving mechanism 72 such that the caps 71 are attached to the ink heads 40. In this preferred embodiment, the capping controller 92 controls the head moving mechanism 30 (see FIG. 1) such that as shown in FIG. 6, the first through fourth ink heads 41 through 44 are located just above the first through fourth caps 71A through 71D respectively. Then, the capping controller 92 controls the upward/downward moving motor 78 of the upward/downward moving mechanism 72 to be driven such that the first through fourth caps 71A through 71D are moved upward. As a result, as shown in FIG. 7, the first through fourth caps 71A through 71D are respectively attached to the first through fourth ink heads 41 through 44.

Next, in step S103 in FIG. 10, the suction process is started. The suction controller 93 shown in FIG. 3 controls the suction pumps 73 to be driven in a state where the caps 71 are attached to the ink heads 40. In this preferred embodiment, the first through fourth suction pumps 73A through 73D are driven at the same time in a state where the first through fourth caps 71A through 71D are respectively attached to the first through fourth ink heads 41 through 44. Therefore, the suction process is started at the same time on the first through ink heads 41 through 44.

In step S103, the suction controller 93 acquires pressures (in this preferred embodiment, referred to as "damper pressures P1") detected by the pressure sensors 59 before the suction process is started, namely, before the suction pumps 73 are driven. In step S103, the damper pressures P1 detected by the pressure sensors 59 are set as "reference pressures P2". As shown in FIG. 3, the suction controller 93 stores the reference pressures P2 on the storage 91. One reference pressure P2 is acquired for each of the dampers 58. In this preferred embodiment, eight reference pressures P2 are stored on the storage 91.

The reference pressures P2 do not need to be acquired in step S103. For example, the reference pressures P2 may be constant and stored in advance on the storage 91.

Next, in step S105 in FIG. 10, the pressure acquisition controller 94 shown in FIG. 3 acquires the damper pressure P1 in each damper 58 during the suction process. In this preferred embodiment, the pressure acquisition controller 94 acquires the damper pressure P1 detected by each pressure sensor 59. For example, the pressure acquisition controller 94 transmits a pressure signal to each pressure sensor 59. Upon receipt of the pressure signal, the pressure sensor 59 detects the damper pressure P1 in the damper 58 and transmits the damper pressure P1 to the pressure acquisition controller 94. The pressure acquisition controller 94 receives the damper pressure P1 transmitted from the pressure sensor 59, and thus acquires the damper pressure P1.

In this preferred embodiment, among the damper pressures P1, the damper pressure P1 in the first damper 58*a* acquired by the first pressure sensor 59*a* (see FIG. 9) is referred to also as a "first damper pressure". The damper pressure P1 in the second damper 58*b* acquired by the second pressure sensor 59*b* (see FIG. 9) is referred to also as a "second damper pressure". The damper pressures P1 acquired by the pressure acquisition controller 94 are stored on the storage 91.

Next, in step S107 in FIG. 10, it is determined whether or not to move the caps 71 upward during the suction process. In this preferred embodiment, the caps 71 are moved upward in the case where the suction of the ink in the ink heads 40 is not performed properly during the suction process. In this preferred embodiment, it is determined whether or not the suction process is performed properly based on a change amount C1 of the damper pressure P1 in each damper 58 between before the start of the suction process and after the start of the suction process.

In step S107, the determination controller 95 determines whether the change amount C1 of the damper pressure P1 is no larger than a reference change amount C2. The "change amount C1 of the damper pressure P1" is calculated based on the reference pressure P2 stored on the storage 91 and the damper pressure P1 acquired by the pressure acquisition controller 94 in step S105. In this preferred embodiment, the change amount C1 of the damper pressure P1 is a difference between the reference pressure P2 and the damper pressure P1.

In this preferred embodiment, among the change amounts C1 of the damper pressures P1, the change amount C1 of the first damper pressure is referred to as a "first change amount". The change amount C1 of the second damper pressure is referred to as a "second change amount". As shown in FIG. 3, the reference change amount C2 is stored in advance on the storage 91.

In this preferred embodiment, in the case where the suction process is performed properly, the ink in the ink head 40 is suctioned, and thus the change amount C1 of the damper pressure P1 is large. Therefore, when the change amount C1 of the damper pressure P1 is larger than the reference change amount C2, the determination controller 95 determines that the suction process is performed properly.

By contrast, in the case where the suction process is not performed properly, the ink in the ink head 40 is not suctioned properly, and thus the change amount C1 of the damper pressure P1 is small. Therefore, when the change amount C1 of the damper pressure P1 is no larger than the reference change amount C2, the determination controller 95 determines that the suction process is not performed properly.

In the case where, as in this preferred embodiment, two dampers 58 (in this example, the first damper 58*a* and the second damper 58*b*) are connected with one ink head 40 as shown in FIG. 9, when the change amount C1 of at least one of the damper pressures P1 is large, it is determined that the suction process is performed properly. Therefore, the determination controller 95 determines whether neither the first change amount of the first damper pressure nor the second change amount of the second damper pressure regarding the one ink head 40 is larger than the reference change amount C2. When at least one of the first change amount of the first damper pressure and the second change amount of the second damper pressure is larger than the reference change amount C2, the determination controller 95 determines that the suction process is performed properly.

By contrast, when the change amounts C1 of the damper pressures P1 in both of the two dampers 58 connected with the one ink head 40 are small, it is determined that the suction process is not performed properly. Therefore, when neither the first change amount of the first damper pressure nor the second change amount of the second damper pressure regarding the one ink head 40 is larger than the reference change amount C2, the determination controller 95 determines that the suction process is not performed properly.

In the case where, as in this preferred embodiment, there are a plurality of ink heads 40 as shown in FIG. 2, for example, in the case where there are four ink heads 40, specifically, the first through fourth ink heads 41 through 44, when the change amounts C1 of the damper pressures P1 regarding all the four ink heads 40 are large, it is determined that the suction process is performed properly. Therefore, the determination controller 95 determines whether the change amount C1 of the damper pressure P1 regarding at least one of the first through fourth ink heads 41 through 44 is no larger than the reference change amount C2. When the change amounts C1 of the damper pressures P1 regarding all the first through fourth ink heads 41 through 44 are larger than the reference change amount C2, the determination controller 95 determines that the suction process is performed properly.

By contrast, when the change amount C1 of the damper pressure P1 regarding at least one of the first through fourth ink heads 41 through 44 is small, it is determined that the suction process is not performed properly. Therefore, when the change amount C1 of the damper pressure P1 regarding at least one of the first through fourth ink heads 41 through 44 is no larger than the reference change amount C2, the determination controller 95 determines that the suction process is not performed properly.

In this preferred embodiment, when it is determined that the suction process is performed properly, the caps 71 are not moved upward during the suction process, and the procedure in the flowchart shown in FIG. 10 is finished. By contrast, when it is determined that the suction process is not performed properly, the procedure advances to step S109 in FIG. 10 in order to perform the suction process properly.

In step S109, the upward/downward movement controller 96 shown in FIG. 3 controls the upward/downward moving mechanism 72 such that the caps 71 are moved upward toward the ink heads 40. In this preferred embodiment, the upward/downward movement controller 96 controls the caps 71 to move upward by a predetermined reference distance L5. As shown in FIG. 3, the reference distance L5 is stored in advance on the storage 91. There is no specific limitation on the numerical value of the reference distance L5. For example, the reference distance L5 is a minimum possible distance by which the upward/downward moving mechanism 72 may move the caps 71. The reference distance L5 is, for example, about 0.1 mm.

Next, in step S111 in FIG. 10, the error controller 97 shown in FIG. 3 determines whether or not an upward moving distance L1 of the caps 71 controlled by the upward/downward movement controller 96 is no shorter than an error distance L2. The "upward moving distance L1" is a distance by which the caps 71 have been moved upward during one cycle of the suction process. The "upward moving distance L1" is a distance by which the upward/downward movement controller 96 has controlled the caps 71 to move upward in step S109. In this preferred embodiment, the upward moving distance L1 is calculated by multiplying the reference distance L5 by the number of times the operation in step S109 is executed.

The "error distance L2" is, for example, a distance by which the caps 71 are moved upward until the absorbers 75 accommodated in the caps 71 are put into contact with the nozzle surfaces 45. As shown in FIG. 3, the error distance L2 is stored in advance on the storage 91.

In step S111, when the upward moving distance L1 of the caps 71 controlled by the upward/downward movement controller 96 is shorter than the error distance L2, the procedure returns to step S105, and the pressure acquisition controller 94 acquires the damper pressure P1 in each damper 58. By contrast, when the upward moving distance L1 of the caps 71 controlled by the upward/downward movement controller 96 is no shorter than the error distance L2 in step S111, the procedure advances to step S113 in FIG. 10.

In step S113, the error controller 97 shown in FIG. 3 performs an error control. The "error control" refers to a control of notifying a user that the suction process was not performed properly. There is no specific limitation on the particulars of the error control. The error controller 97, for example, displays an error message on the display screen 81 (see FIG. 1) of the operation panel 80 as an error control. The "error message" refers to a message indicating that, for example, the suction process was not performed properly. The user may see the error message displayed on the display screen 81 to learn that the suction process was not performed properly. In this case, the user may, for example, inquire with the customer service center.

When the error control is performed as described above, the procedure in the flowchart shown in FIG. 10 is finished. In this preferred embodiment, after the error control is performed, the suction pumps 73 are stopped to finish the suction process.

As described above, in this preferred embodiment, as shown in FIG. 9, the printer 10 includes the ink heads 40, the dampers 58, the pressure sensors 59, the caps 71, the upward/downward moving mechanism 72 (see FIG. 6), the suction pumps 73 (see FIG. 6), and the controller 90 (see FIG. 3). The ink heads 40 each include the nozzles 46 through which the ink is injected. The dampers 58 are connected with the corresponding ink head 40. The pressure sensors 59 each detect the damper pressure in the corresponding damper 58. The caps 71 are each attached to the corresponding ink head 40 so as to cover the nozzles 46. As shown in FIG. 6 and FIG. 7, the upward/downward moving mechanism 72 moves the caps 71 upward and downward with respect to the ink heads 40. The suction pumps 73 are each connected with the corresponding cap 71. As shown in FIG. 3, the controller 90 is configured or programmed to include the suction controller 93, the pressure acquisition controller 94, the determination controller 95, and the upward/downward movement controller 96. As shown in step S103 in FIG. 10, the suction controller 93 executes the suction process of driving the suction pumps 73 in a state where the caps 71 are attached to the ink heads 40. As shown in step S105 in FIG. 10, the pressure acquisition controller 94 acquires the damper pressure P1 detected by each of the pressure sensors 59 during the suction process. As shown in step S107 in FIG. 10, the determination controller 95 determines whether the change amount C1 of each damper pressure P1 is no larger than the reference change amount C2. When the change amount C1 of the damper pressure P1 is no larger than the reference change amount C2, the upward/downward movement controller 96 controls the caps 71 to move upward toward the ink heads 40 as shown in step S109 in FIG. 10.

According to this preferred embodiment, when the change amount C1 of a particular damper pressure P1 is large during the suction process, the pressure in the cap 71 is of a negative level. Thus, it is considered that the ink is suctioned properly from the ink head 40. By contrast, when the change amount C1 of the damper pressure P1 is small during the suction process, the cap 71 is not attached to the ink head 40 properly, and the pressure in the cap 71 is not at a sufficiently negative level. In this case, it is considered that the ink is not suctioned properly from the ink head 40. In this preferred embodiment, when the change amount C1 of the damper pressure P1 is no larger than the reference change amount C2, it is determined that the suction process is not performed properly because the change amount C1 is small. Therefore, the caps 71 are moved upward. This moves the caps 71 toward the ink heads 40, and are put into in closer contact with the ink heads 40. As a result, the pressure in the cap 71 is decreased to a sufficiently negative level. This allows the suction process to be performed properly.

In this preferred embodiment, the caps 71 are formed of rubber. There are a variety of types of rubber. For example, there are soft rubber and hard rubber. Some types of rubber may exhibit an aging change when being in contact with ink. Therefore, there are types of rubber suitable to be used with ink and types of rubber not suitable to be used with ink. In this preferred embodiment, in the case where the suction process is not performed properly due to an aging change of the rubber forming the caps 71, the caps 71 are moved upward to be put into closer contact with the ink heads 40. Therefore, even in the case where the caps 71 are formed of rubber that may exhibit an aging change, the suction process is performed properly. This broadens the range of types of rubber that are usable to form the caps 71.

In this preferred embodiment, in the case where the suction process is not performed properly due to the aging deterioration of the rubber forming the caps 71, the caps 71 are moved upward to be put into closer contact with the ink heads 40 during the suction process. Therefore, the suction process is performed properly even if the rubber forming the caps 71 exhibits an aging deterioration.

In this preferred embodiment, the controller 90 includes the storage 91. On the storage 91, the reference pressure P2 (see FIG. 3) is stored, which is the damper pressure P1 in a state where the corresponding cap 71 is attached to the ink head 40 and the suction pump 73 is not driven. The determination controller 95 shown in FIG. 3 sets, as the change amount C1 of the damper pressure P1, a difference between the reference pressure P2 and the damper pressure P1 acquired by the pressure acquisition controller 94 in step S107 in FIG. 10. Namely, the change amount C1 of the damper pressure P1 is set as the difference between the damper pressure P1 during the suction process and the reference pressure P2, which is the pressure in a state where the suction process it not performed. Therefore, the determination controller 95 may determine whether or not the suction process is performed properly based on the change amount C1 from the reference pressure P2.

In this preferred embodiment, in step S103 in FIG. 10, the suction controller 93 stores the damper pressure P1, detected by the pressure sensor 59 before driving the suction pump 73, on the storage 91 as the reference pressure P2. This sets, as the change amount C1, the difference between the pre-suction process damper pressure P1 (reference pressure P2) and the damper pressure P1 during the suction process. Therefore, the change amount C1 may be calculated more accurately.

In this preferred embodiment, as shown in FIG. 9, the nozzles 46 include the first nozzles 46*a* and the second nozzles 46*b*. The dampers 58 include the first damper 58*a* connected with the first nozzles 46*a* and the second damper 58*b* connected with the second nozzles 46*b*. The pressure sensors 59 include the first pressure sensor 59*a* detecting the first damper pressure in the first damper 58*a* and the second pressure sensor 59*b* detecting the second damper pressure in the second damper 58*b*. In step S105 in FIG. 10, the pressure acquisition controller 94 shown in FIG. 3 acquires the first damper pressure and the second damper pressure during the suction process. In step S107 in FIG. 10, the determination controller 95 shown in FIG. 3 determines whether neither the first change amount of the first damper pressure nor the second change amount of the second damper pressure is larger than the reference change amount C2. When neither the first change amount nor the second change amount is larger than the reference change amount C2, the upward/downward movement controller 96 shown in FIG. 3 moves the caps 71 toward the ink heads 40 in step S109 in FIG. 10.

In the case where the two dampers 58*a* and 58*b* are provided for one ink head 40 as described above, when the change amount C1 of at least one of the damper pressures P1 is large, it may be determined that the suction process is performed properly on the one ink head 40. By contrast, when the change amounts C1 of both of the damper pressures P1 are small, it may be determined that the suction process is not performed properly on the one ink head 40.

In this preferred embodiment, as shown in FIG. 2, the printer 10 includes the plurality of ink heads 40 (in this example, the first through fourth ink heads 41 through 44). As shown in FIG. 9, the dampers 58, the pressure sensors 59, the cap 71 and the suction pump 73 are provided for each of the ink heads 40. As shown in FIG. 6 and FIG. 7, the upward/downward moving mechanism 72 moves the plurality of caps 71 (in this example, the first through fourth caps 71A through 71D) collectively. In step S105 in FIG. 10, the pressure acquisition controller 94 shown in FIG. 3 acquires the damper pressures P1 detected by the pressure sensors 59 corresponding to each ink head 40 during the suction process. In step S107 in FIG. 10, the determination controller 95 shown in FIG. 3 determines whether the change amount C1 of at least one of the damper pressures P1 corresponding to each ink head 40 is no larger than the reference change amount C2. When the change amount C1 of at least one of the damper pressures P1 corresponding to each ink head 40 is no larger than the reference change amount C2, the upward/downward movement controller 96 shown in FIG. 3 moves the plurality of caps 71 upward in step S109 in FIG. 10. As described above, with the structure where the plurality of caps 71 are moved upward collectively (i.e., at the same time), in the case where the suction process is not performed properly on one of the plurality of ink heads 40, the caps 71 are moved upward collectively. Therefore, the suction process may be performed properly on all the ink heads 40.

In this preferred embodiment, for example, the second ink head 42 corresponds to "another ink head". At least one of the dampers 58 connected with the second ink head 42 corresponds to "another damper". At least one of the pressure sensors 59 detecting the pressures of the dampers 58 connected with the second ink head 42 corresponds to "another pressure sensor". The second cap 71B corresponds to "another cap", and the second suction pump 73B corresponds to "another suction pump".

In this preferred embodiment, in step S109 in FIG. 10, the upward/downward movement controller 96 moves the caps 71 upward by the reference distance L5. After the caps 71 are controlled by the upward/downward movement controller 96 to move upward by the reference distance L5, the pressure acquisition controller 94 acquires the damper pressures P1 in step S105 in FIG. 10. This allows the caps 71 to be moved upward gradually by the reference distance L5 until the change amount C1 of each damper pressure P1 is increased to be larger than the reference change amount C2. Therefore, the caps 71 are suppressed from being moved upward excessively.

In this preferred embodiment, the controller 90 includes the error controller 97 (see FIG. 3). When, in step S111 in FIG. 10, the upward moving distance L1, by which the caps 71 are controlled by the upward/downward movement controller 96 to move upward, is no shorter than the error distance L2, the error controller 97 performs the error control in step S113 in FIG. 10. In the case where, for example, the upward moving distance L1 of the caps 71 is too long, the absorbers 75 of the caps 71 may, for example, contact the nozzle surfaces 45. When the absorbers 75 contact the nozzle surfaces 45, there is an undesirable possibility that the meniscus of each of the nozzles 46 is not adjusted properly. Therefore, it is preferred that the absorbers 75 do not contact the nozzle surfaces 45. For this reason, in this preferred embodiment, when the upward moving distance L1 of the caps 71 is no shorter than the error distance L2, the error control is performed and the suction process is finished. In this manner, such a situation may be prevented that the upward moving distance L1 of the caps 71 is too long and as a result, the absorbers 75 in the caps 71 contact the nozzle surfaces 45.

In this preferred embodiment, the two dampers 58 (in this example, the first damper 58*a* and the second damper 58*b*) are provided for one ink head 40. Alternatively, one damper 58 may be provided for one ink head 40, or, for example, three or more dampers 58 may be provided for one ink head 40.

In this preferred embodiment, the pressure sensors 59 each detect the damper pressure P1 in the corresponding damper 58 at a predetermined time point. The pressure sensor 59 detects the damper pressure P1 with a numerical value. The pressure sensor 59 is not limited to detecting the damper pressure P1 with a numerical value. For example, the pressure sensor 59 may detect whether the damper pressure P1 in the damper 58 is no smaller than a predetermined pressure (e.g., lower-limit pressure). The pressure sensor 59 may be, for example, a filler sensor disclosed in Japanese Laid-Open Patent Publication No. 2019-107852. In this case, the filler sensor detects whether the damper pressure P1 during the suction process is no smaller than the predetermined pressure. When, for example, the filler sensor hits to detect that the damper pressure P1 during the suction process is changed to a level smaller than the predetermined pressure, the determination controller 95 determines that the suction process is performed properly. By contrast, when a state where the filler sensor does not hit is continued even though the suction process is performed and thus it is detected that the damper pressure P1 is still no smaller than the predetermined pressure, the determination controller 95 determines that the suction process is not proper, and thus the upward/downward movement controller 96 moves the caps 71 upward toward the ink heads 40.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

an ink head including a nozzle through which ink is injected;

a damper connected with the ink head;

a pressure sensor to detect a damper pressure in the damper;

a cap attachable to the ink head so as to cover the nozzle;

an upward/downward moving mechanism to move the cap upward and downward with respect to the ink head;

a suction pump connected with the cap; and a controller configured or programmed to include:

a suction controller to execute a suction process of driving the suction pump in a state where the cap is attached to the ink head;

a pressure acquisition controller to acquire the damper pressure detected by the pressure sensor during the suction process;

a determination controller to determine whether a change amount of the damper pressure is no larger than a reference change amount; and an upward/downward movement controller to control the cap to move upward toward the ink head when the change amount is no larger than the reference change amount.

2. The inkjet printer according to claim 1, wherein the controller is configured or programmed to include a storage having a reference pressure stored thereon, the reference pressure being the damper pressure in a state where the cap is attached to the ink head and the suction pump is not driven; and the determination controller is configured or programmed to set, as the change amount, a difference between the reference pressure and the damper pressure acquired by the pressure acquisition controller.

3. The inkjet printer according to claim 2, wherein the suction controller is configured or programmed to store the damper pressure detected by the pressure sensor on the storage as the reference pressure before driving the suction pump.

4. The inkjet printer according to claim 1, wherein the nozzle includes a first nozzle and a second nozzle;

the damper includes:

a first damper connected with the first nozzle; and a second damper connected with the second nozzle;

the pressure sensor includes:

a first pressure sensor to detect a first damper pressure in the first damper; and a second pressure sensor to detect a second damper pressure in the second damper;

the pressure acquisition controller is configured or programmed to acquire the first damper pressure and the second damper pressure during the suction process;

the determination controller is configured or programmed to determine whether neither a first change amount of the first damper pressure nor a second change amount of the second damper pressure is larger than the reference change amount; and when neither the first change amount of the first damper pressure nor the second change amount of the second damper pressure is larger than the reference change amount, the upward/downward movement controller is configured or programmed to control the cap to move upward toward the ink head.

5. The inkjet printer according to claim 1, further comprising:

another ink head;

another damper connected with the another ink head;

another pressure sensor to detect another damper pressure in the another damper;

another cap attachable to the another ink head; and another suction pump connected with the another cap; wherein the upward/downward moving mechanism is configured or programmed to move the cap and the another cap collectively;

the pressure acquisition controller is configured or programmed to acquire the another damper pressure detected by the another pressure sensor during the suction process;

the determination controller is configured or programmed to determine whether at least one of the change amount of the damper pressure and another change amount of the another damper pressure is no larger than the reference change amount;

when at least one of the change amount of the damper pressure and the another change amount of the another damper pressure is no larger than the reference change amount, the upward/downward movement controller is configured or programmed to control the cap and the another cap to move upward.

6. The inkjet printer according to claim 1, wherein the upward/downward movement controller is configured or programmed to control the cap to move by a reference distance; and the pressure acquisition controller is configured or programmed to acquire the damper pressure after the cap is controlled by the upward/downward movement controller to move upward by the reference distance.

7. The inkjet printer according to claim 1, wherein the controller is configured or programmed to include an error controller to perform an error control when an upward moving distance by which the cap is controlled by the upward/downward movement controller to move upward is no shorter than an error distance.

8. The inkjet printer according to claim 7, wherein the error controller is configured or programmed to display an error message as the error control.

* * * * *